US005489031A

United States Patent [19]

Carroll

[11] Patent Number: 5,489,031

[45] Date of Patent: Feb. 6, 1996

[54] SHELVING SYSTEM WITH ELONGATE GRIPPING MEMBER

[75] Inventor: Francis A. Carroll, Dublin, Ireland

[73] Assignee: Carroll Products and Designs Limited, Dublin, Ireland

[21] Appl. No.: 211,859

[22] PCT Filed: Oct. 16, 1992

[86] PCT No.: PCT/IE92/00018

§ 371 Date: Apr. 15, 1994

§ 102(e) Date: Apr. 15, 1994

[87] PCT Pub. No.: WO93/07785

PCT Pub. Date: Apr. 29, 1993

[30] Foreign Application Priority Data

Oct. 16, 1991 [IE] Ireland ..... 3566/91

[51] Int. Cl.[6] ..... A47F 5/00

[52] U.S. Cl. ..... 211/86; 211/184

[58] Field of Search ..... 211/184, 153, 211/86; 108/60, 61, 108, 109

[56] References Cited

U.S. PATENT DOCUMENTS 4,190,167 2/1980 Wells et al. ..... 211/184

4,765,492 8/1988 Howard et al. ..... 211/184 X 4,775,058 10/1988 Yatsko ..... 211/184

5,341,945 8/1994 Gibson ..... 211/184

5,353,939 10/1994 Beeler et al. ..... 211/184 X

*Primary Examiner*—David M. Purol

*Attorney, Agent, or Firm*—Hoffmann & Baron

[57] ABSTRACT

Shelving system including a shelf, risers and dividers. At the front of the shelf is a spring-loaded gripping member for accommodating the riser. The riser is provided with a number of slots which engage about rods or shanks of the gripping member. The rear face of the shelf is provided with an up-stand which provides a low rear wall for the shelf and provides a way to retain connector clips in position. A gripping and facia element is located on heads of the rods. The gripping member has springs, which are contained in a housing formed by cooperating elements. To operate the gripping member, pressure is applied along the axis of the rods. On release of the pressure, the assembly returns to its closed position.

13 Claims, 17 Drawing Sheets

SHELVING SYSTEM WITH ELONGATE GRIPPING MEMBER

FIELD OF THE INVENTION

The present invention relates to shelving, particularly to modular metal shelving for use in retail outlets to display and merchandise consumer products for general use throughout the retail industry. Such shelving is used in ambient and refrigerated conditions.

DESCRIPTION OF THE PRIOR ART

A necessary feature of such shelving is the provision of means to accommodate shelf sub-division elements known in the industry as 'risers and dividers' which are used to subdivide a shelf into separate areas to hold different types of goods in isolation, prevent the goods from mixing and in the case of sloping shelves from falling off the shelves.

These risers and dividers can be made of many materials but generally are of either glass, transparent plastics materials or wire construction in the form of a flat grid, all of which allow the product displayed on the shelf to be seen through the risers/dividers. By definition the 'risers' are the sub-divider elements fixed to the front and back of the shelf while the 'dividers' are the adjustable sub-divider elements which run from the front to the back of the shelf and are connected to, and supported by, the riser elements by means of various connectors.

Prior art shelves have been designed in numerous different ways to accommodate the fixing and supporting of riser elements of the various materials described above. Two solutions have emerged which dominate the retail metal shelving markets:

Type A: Shelving with recessed narrow channels 202, 203 formed along the front 204 and back 205 of the shelves 201 to accommodate the riser elements 206 (see FIG. 1)

Type B: Shelving with small holes 209 or slots punched along the front 210 and back 211 of the shelves 208 at close intervals in lines parallel to and close to the edges of the shelf to accommodate pins 212 fixed to or forming part of the risers. In this case, it is also necessary to provide a second perforated landing 214 under the shelf proper to accept the pins and give the riser stability not provided by the thin metal of the shelf (see FIG. 2)

A variation of the type A shelf is disclosed in DE-B-1102545 in which a biasing clip is included in the front and rear channels.

Shelf types 'A' and 'B' constitute the vast majority of all modular metal shelves produced commercially and the remaining shelf types either have no means to accommodate risers and dividers or feature variations of the retaining shelf types 'A' or 'B'.

There are a number of disadvantages associated with the prior art shelving namely:

(a) Type 'A' shelves, of necessity, are manufactured with channels of predetermined width and cannot be altered to accommodate risers of different thicknesses which may be more suitable or economical to use.

(b) Type 'A' shelves are considered a potential health hazard when used to display food products by providing a place for food particles to lodge and bacteria to incubate. Health Authorities have already banned the use of this type of shelf in some instances.

(c) Type 'B' shelves are ideally suited for wire grid risers which can easily incorporate projecting wire pins to support risers but this type of riser is no longer visually acceptable to most retailers as the visible wire construction detracts from the presentation of products on display. This shelf cannot easily accommodate glass risers as there is no practical way to connect projecting pins to glass and the alternative solution of a metal sub-structure is most unsatisfactory and expensive. Risers manufactured from transparent plastics material can more easily be accommodated but at additional expense over type 'A' shelf risers.

(d) Perforated holes in type 'B' shelves are also now considered to be a potential health hazard when used to display food products particularly meat and similar products having a high liquid content. Health Authorities have also banned this type of shelf in some instances.

(e) Type 'B' shelves with perforated holes/slots at the back and front are, of necessity, very wasteful of shelf space taken up by the distance from shelf edge to the centre line of the perforations, thus reducing the effective depth of the shelf. Where back risers are used this waste space is doubled.

(f) Type 'B' shelves have perforated holes/slots at close centres at back and front of shelves and duplicated underneath as described. Consequently, an average 1 m shelf would have as many as 80 small holes/slots punched in its surface. The cost of providing and maintaining tooling for this punching operation, particularly in modern mechanised production, is very expensive and adds considerably to the set up and production costs of same.

(g) Shelving types 'A' and 'B' both fail to provide a means to accommodate all accepted forms of risers in various materials and thickness as chosen by the end user for considerations of material efficiency, visual attractiveness and suitability for the product to be displayed.

(h) Both types of shelves require the provision of a back riser element merely to support the divider element at the rear. This back riser has no function other than to support the dividers and is very wasteful of material and cost.

SUMMARY OF THE INVENTION

It is an object of this invention to provide a shelf design which alleviates the disadvantages of prior art shelving and offers new advantageous features to the shelving manufacturer, shopfitter and retailer alike.

The present invention and its advantageous features are defined in the appended claims.

As advantages over the prior art, a shelf having the features of the invention provides:

(a) a homogeneous top surface which is unbroken by e.g. channels, holes or slots.

(b) accommodation of a front riser of any material or thickness.

(c) the possibility of closing and sealing the front riser gap when not in use.

d) accommodation of ticket and EPOS (bar coded) strips in different forms including electronic strips.

(e) accommodation of many additional beneficial elements to the shelf edge, e.g. point of sale material.

(f) the elimination of a back riser element.

(g) the elimination of waste shelf space associated with the traditional use of risers.

(h) the ability to remove easily the shelf facia element to facilitate thorough cleaning of the shelf structure.

(i) a solution to the hygiene problems associated with prior art shelving in relation to food merchandising.

(j) a means to manufacture shelving more economically by eliminating expensive perforations, channels, etc.

The invention will hereinafter be more particularly described with reference to the accompanying drawings which show, by way of example, a number of embodiments according to the invention.

DESCRIPTION OF THE PREFERRED EMBODIMENTS

Figure 14:
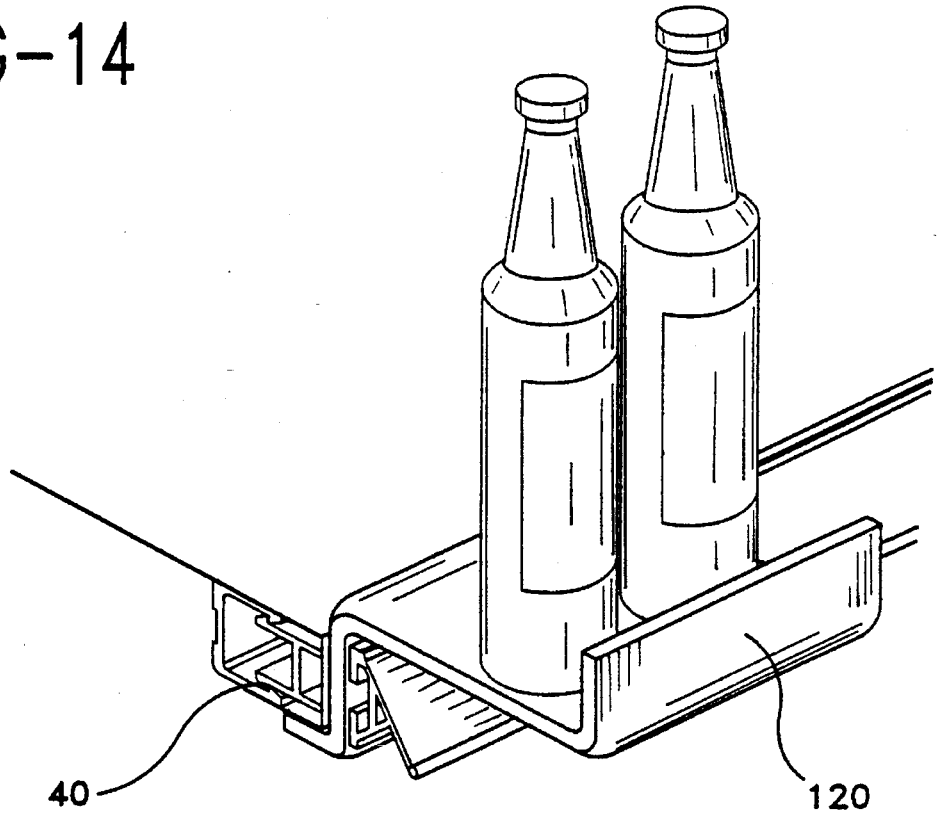
FIG. 14 is a perspective view of the shelf with the gripping member engaging a shelf extension element.

In the drawings, the shelving system comprises a shelf 10 a riser 20 and three dividers 30. The shelf may of course be of any length and may have as many dividers or risers as required. At the front of the shelf is a spring loaded gripping member 40 for accommodating the riser 20 which is provided with a number of slots 22 which engage about rods or shanks 42 of the gripping member 40. The rear face of the shelf is provided with an up-stand 50 which provides a low rear wall for the shelf and provides a means to retain connector clips 60 in position. This up-stand 50 has an additional advantage as a shelf limiter and spillage controller preventing accidental product spillage, particularly liquid, from running down the back of the shelves where cleaning is most difficult. A number of clips 60 are provided at the rear of the shelf which engage on to the shelf and are held in position by the resilience of the clips and the shape of the shelf member itself. As shown in FIG. 14, each clip 60 accommodates the lower rear corner of a divider 30 in a grip 62. Two pips 64 in the grip 62 engage in an optional slot 32 of the divider 30. The front upper corner of each divider 30 is provided with a connector 70 which fits about the riser 20. (Similar clips 60 and connectors 70 are disclosed in the specification of our Irish Patent Application No. 90/88 and the corresponding U.K. published Application No. 2241878A the disclosure of which is included herein by reference).

Referring to FIGS. 9*a*–11*c*, the gripping member 40 includes a gripping and facia element 41 which is also provided with a channel 85 which a user slides longitudinally in a generally horizontal direction over the front caps of the rods 42. In the embodiments shown, the travel possible of the facia 41 from the front wall of the shelf unit 10 is approximately 10 mm. This way it can accommodate risers of any thickness from 1 to 10 mm. Of course it is possible to construct a mechanism to give further travel if required, to suit the circumstances.

Figure 1:
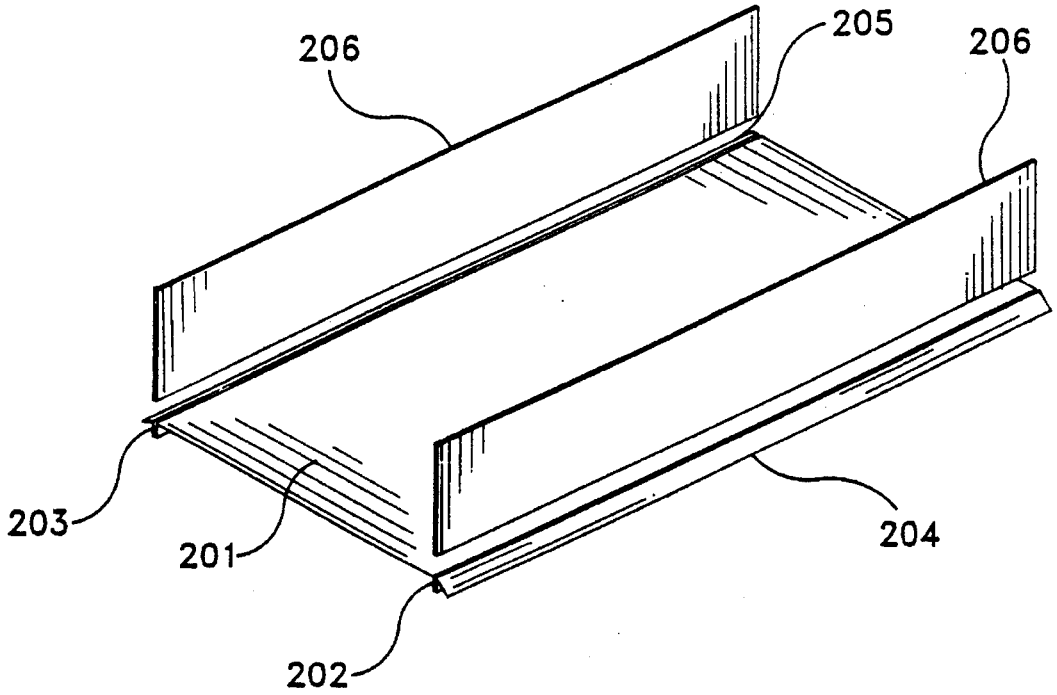
FIG-1 PRIOR ART
FIG. 1 shows a 'TYPE A' shelf according to the prior art.
Figure 2:
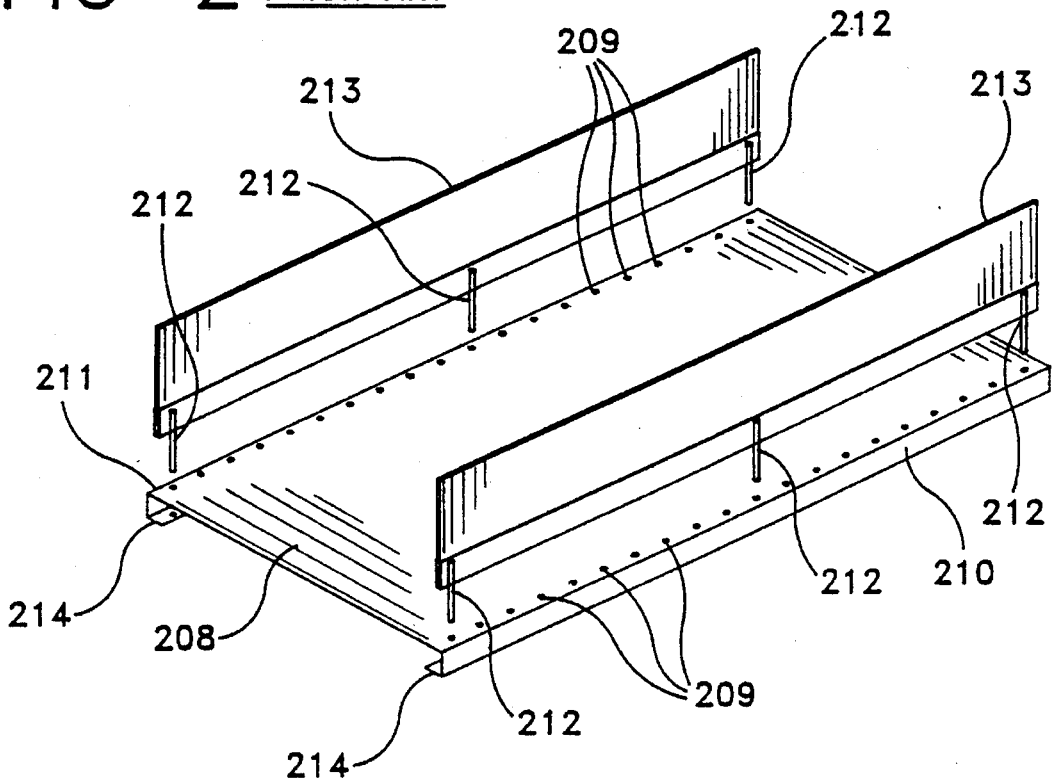
FIG-2 PRIOR ART
FIG. 2 shows a 'TYPE B' shelf according to the prior art.
Figure 3:
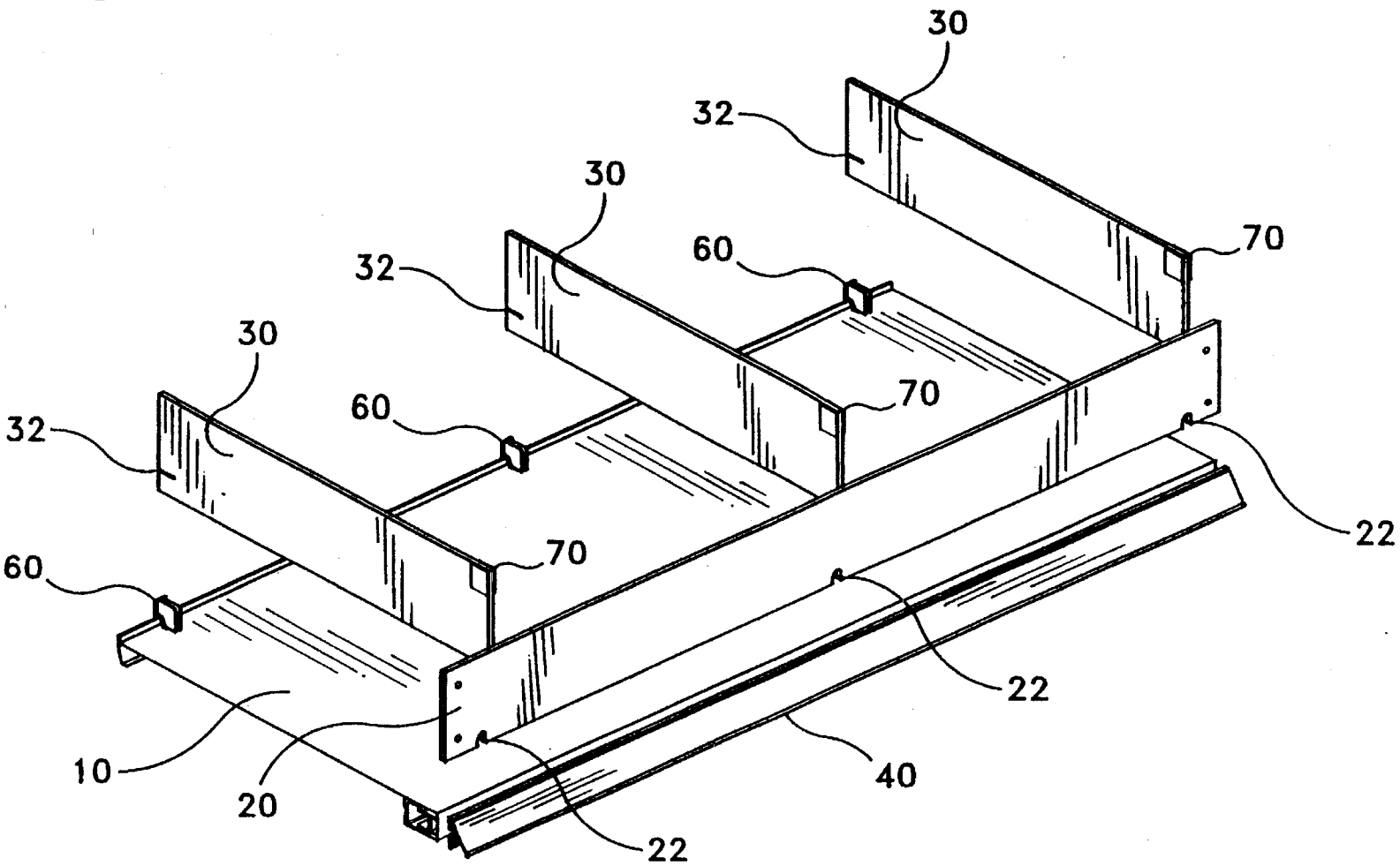
FIG. 3 is a partially exploded perspective view of a shelf according to the invention showing a riser and three dividers.
Figure 4:
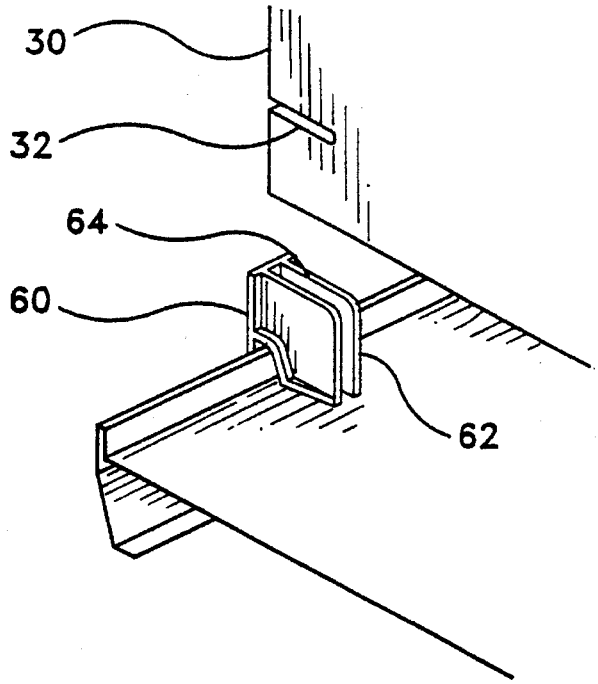
FIG. 4 shows more details of the rear of the shelf of FIG. 3.
Figure 5:
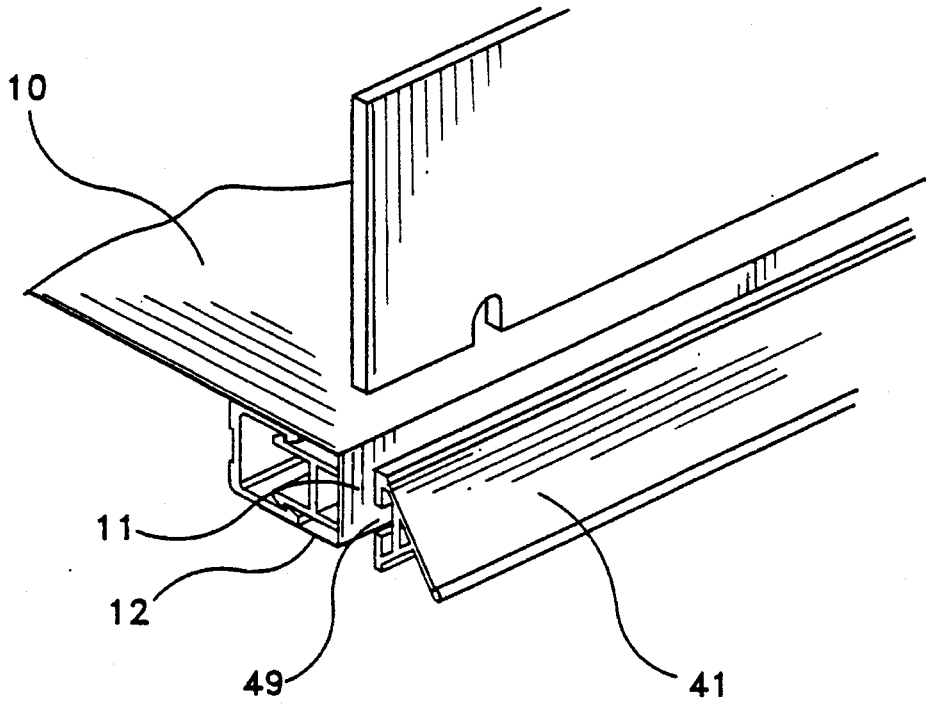
FIG. 5 shows more details of the front of the shelf of FIG. 3.
Figure 7:
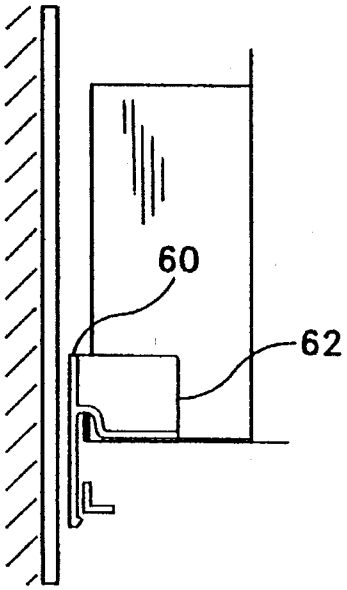
FIG. 7 is a partial cross-sectional side view similar to FIG. 6 but showing an alternative construction for the rear of the shelf.
Figure 6:
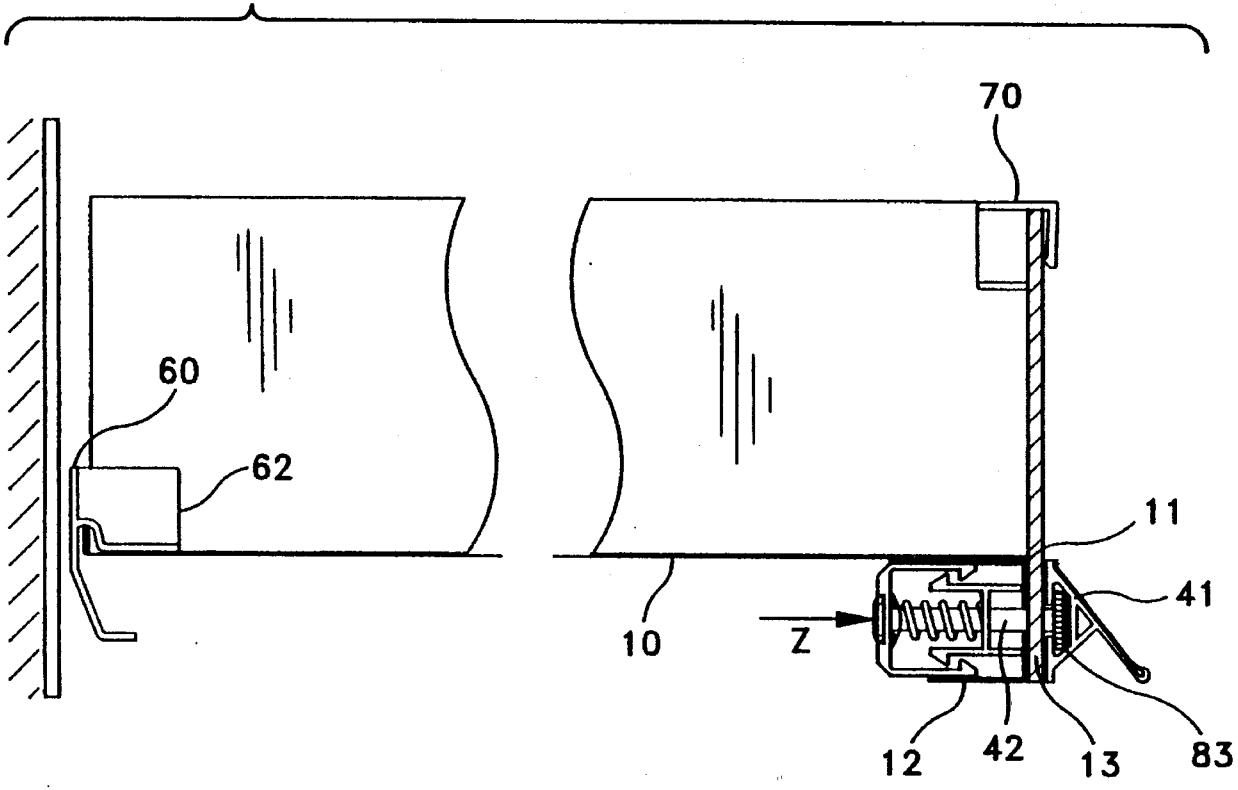
FIG. 6 is a cross-sectional side view through an assembled shelf including a grilling member.
Figure 8:
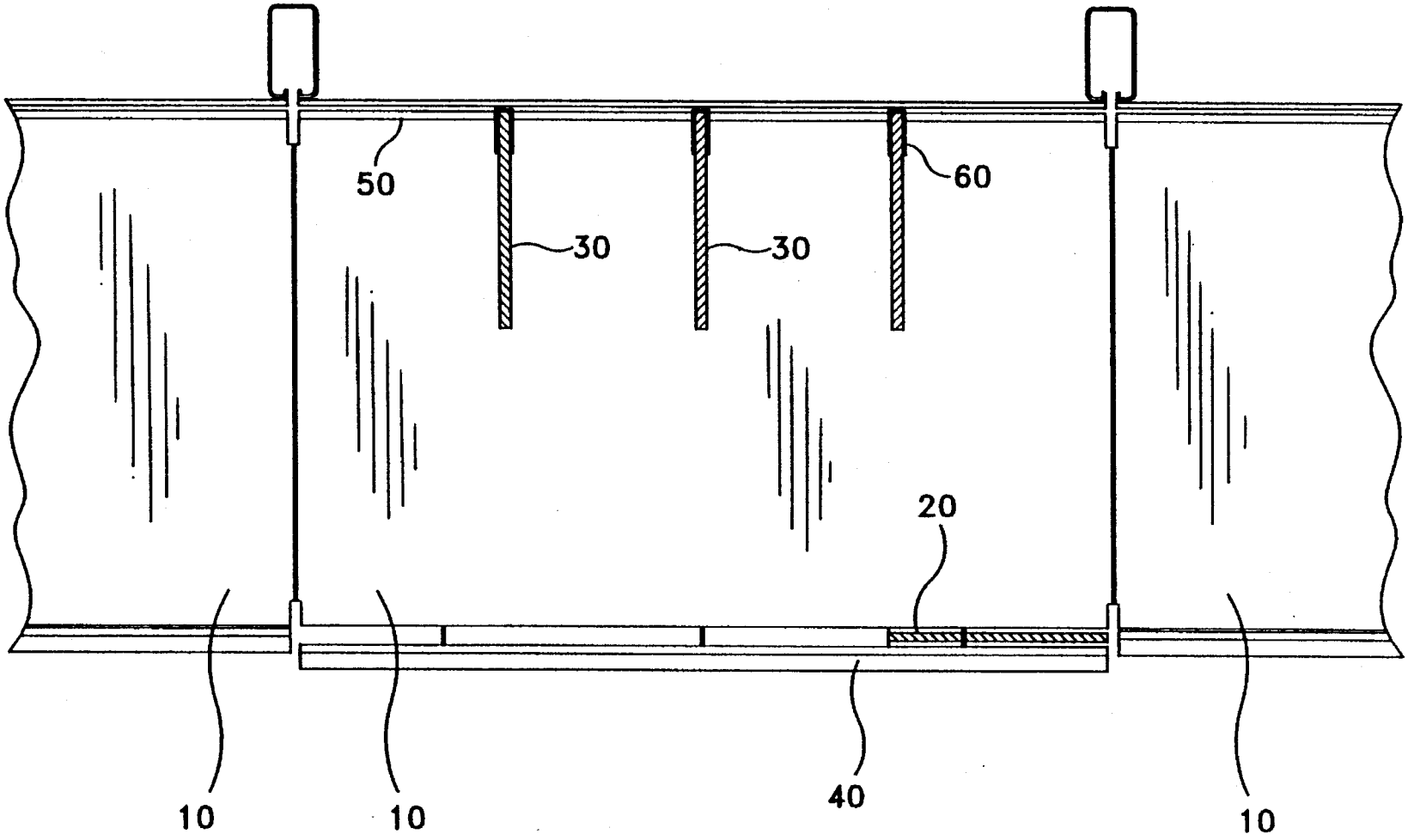
FIG. 8 is a plan view of the shelf.
Figure 9A:
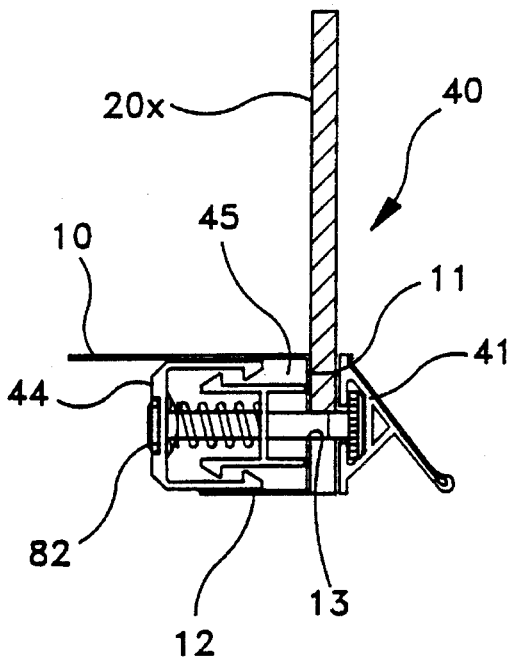
FIGS. 9*a*–9*c* are cross-sectional detailed views of the gripping member having different heights and thicknesses of risers contained therein.
Figure 9B:
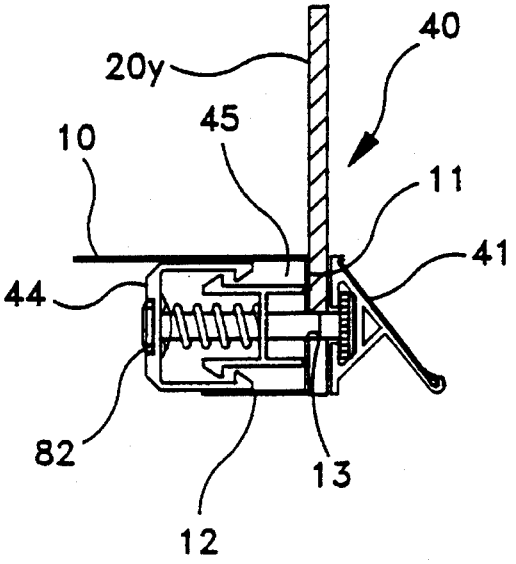
Figure 9C:
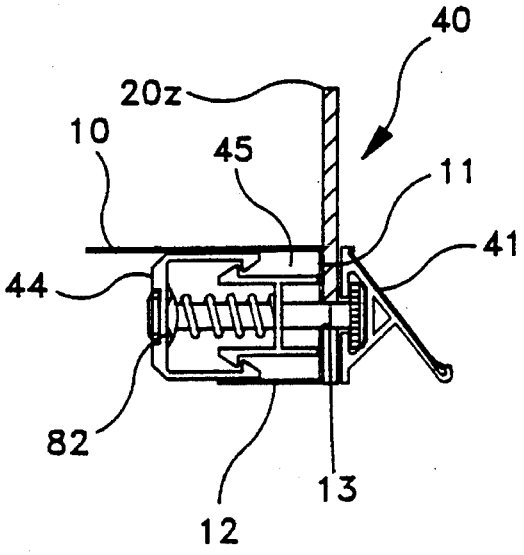

The bias of the gripping member 40 is provided by a spring 43 which is located about the rod 42. The rear head of the rod 42 engages a first extrusion 44 which cooperates with a second extrusion 45 to form a housing. Separation of the elements 44 and 45 is prevented by the ends of the two extrusions engaging by means of the formations and 48, respectively provided thereon. The rods 42 are spaced apart approximately 250–300 mm. between centres along the depending skirt 11 of the shelf 10. The extrusions 44 and 45 may be of plastic or metal and are housed within the U-shaped profile 12 provided on the edge of the shelf 10. To operate the gripping member 40, pressure is applied to the underside of the shelf as shown by arrow Z indicated in FIG. 6. On release of the pressure, the assembly, under the action of the spring 43, returns to its closed position sealing the gap created. If required, the gripping and facia element 41 may be removed in which case all that is visible at the front of the shelf are the front caps 83 of the rods 42. In this way, there are no concealed areas in which food or any other product may accumulate. The rods 42 and rod ends may advantageously be manufactured from hygienic moulded plastics material.

Figure 10:
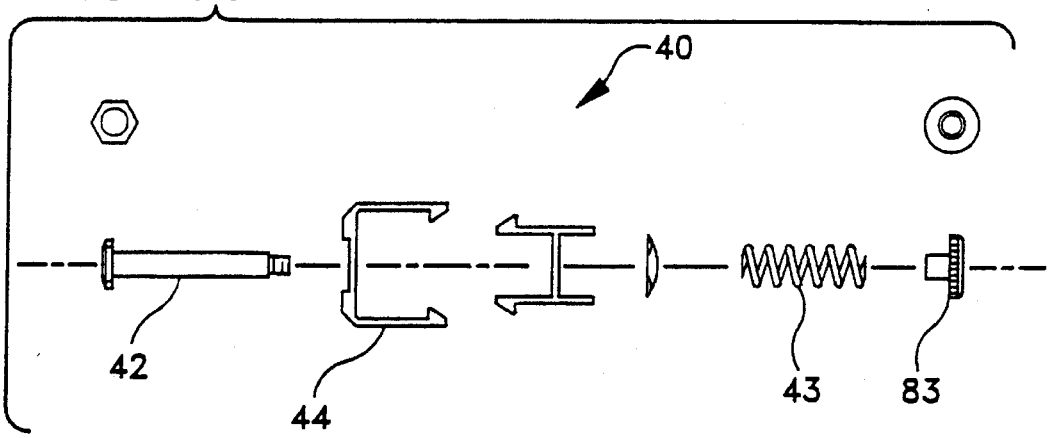
FIG. 10 is an exploded view of components of the gripping member.
Figure 11A:
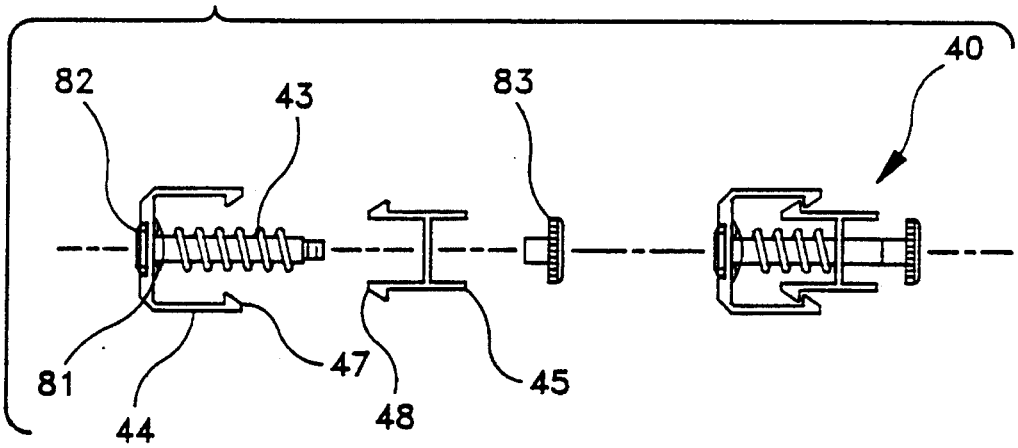
FIGS. 11*a*–11*c* are four progressive views showing the assembly of the gripping member.
Figure 11B:
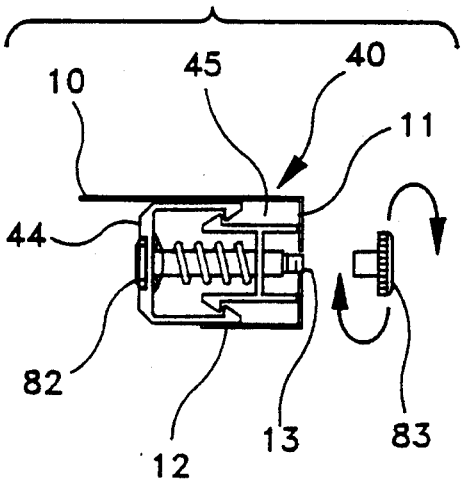
Figure 11C:
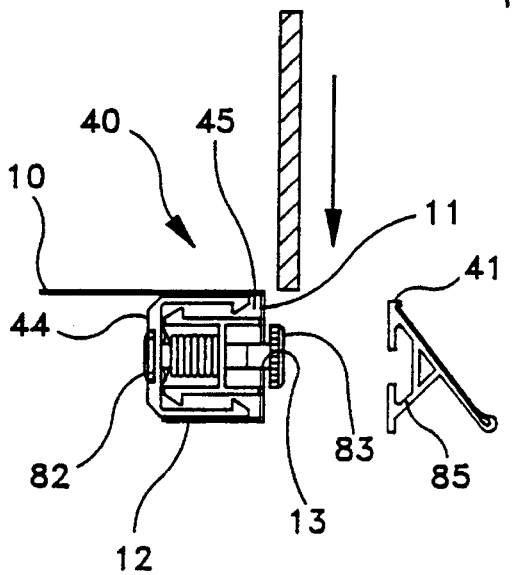

Referring to FIGS. 10–11*c*, the mechanism for the gripping member 40 is shown therein. Each rod 42 is first fitted into the extruded U-shaped element 44 and held in position by a captive washer 81 retaining the head 82 of the rod 42 against the extruded element 44. A spring 43 is then fitted over the rod 42 followed by a H-shaped extruded element 45 which when pressed home against element 44 engages projections 47 and 48 on each of elements 44 and 45, respectively thus completing the spring loaded assembly as shown in FIG. 11*a*–11*c*. A retaining press on/screw off cap 83 engages the end of the rod 42 through an orifice 13 provided in the depending skirt 11 of the metal shelf. The gripping and facia element 41 then engages the rod 42 about the cap 83 by means of the channel 85 provided thereon.

The travel stops of the gripping member are provided by the ends of the extruded element 45 engaging the inside of the extruded element 44 and by the gripping element 41 engaging the depending skirt 11 or a retained riser 20*x*, 20*y* or 20*z* or any other elements retained therein.

Figure 12A:
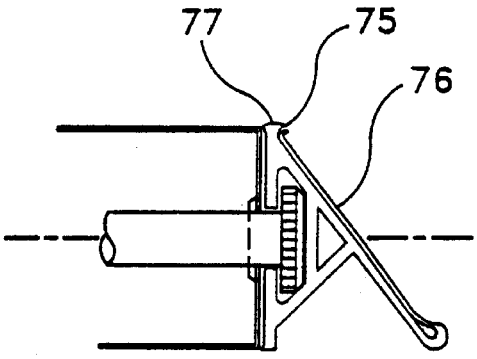
FIGS. 12*a*–12*e* are cross-sectional side views through the external portion of the gripping member showing alternative one piece and two piece extrusions and pressings for use as a gripping element and front facia.

Further variations of the gripping element and facia design are shown in FIGS. 12*a*–12*e*. In FIG. 12*a* the gripping element and facia 75 is a one piece extrusion and has a flap 76 to accommodate a ticket strip. The flap 76 is biased into a a closed position and can be bent outwards to replace or insert an EPOS ticket strip or similar. Flap 76 is also at an angle for ease of viewing of the customer. The edges 77 of the extrusion are feathered to blend in to the shelf profile and close off any areas where foreign matter might collect.

Figure 12B:
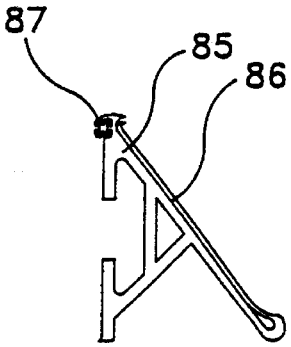

In FIG. 12*b*, the gripping element and facia 85 includes a seal 87 which prevents any liquid coming between the shelf and the element. The gripping element and facia 85 also have a flap 86 similar to flap 76.

Figure 12C:
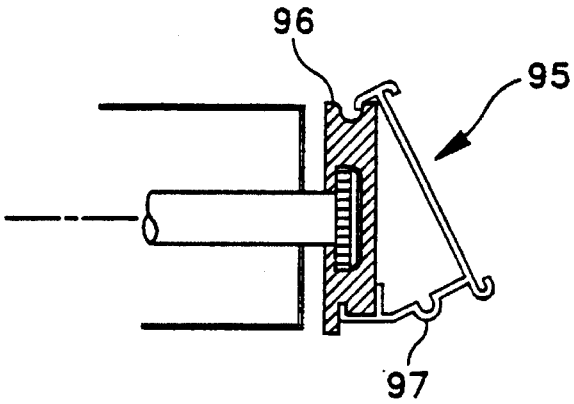
Figure 12D:
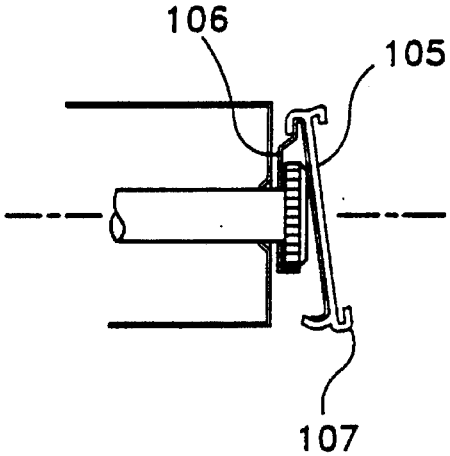

Facia 95 shown in FIG. 12*c* is a two piece assembly comprising a gripping element 96 of extruded aluminium for strength and stiffness and an edge strip 97 of extruded plastic fitted over the element 96. The edge strip 97 can be of many different forms to suit end user requirements in terms of size, angle, open or closed flaps to retain ticket strips, etc. The facia element 105 shown in FIG. 12*d* is also a two piece construction with a gripping element 106, in the form of a metal pressing, provided with a plastics extruded edge strip 107 which engages about the element 106. The metal element 106 is slotted to coincide with the rods 42 and snapped into position over the heads of the rods.

Figure 12E:
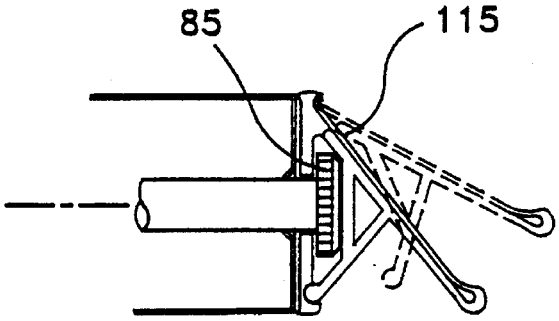

The combined gripping element and facia 115 shown in FIG. 12*e* is a one piece extrusion which can be opened to allow the back leg of the extrusion to be slotted to coincide with gripping element rods 42 thus allowing the facia to be slid into position using a vertical rather than a horizontal motion.

Figure 13A:
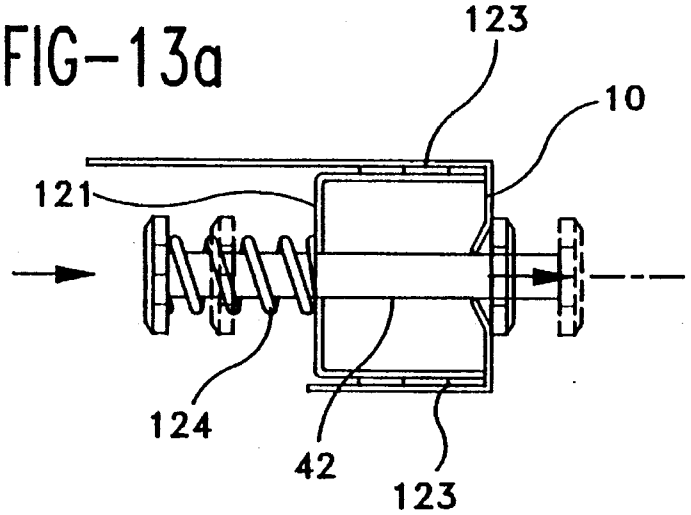
FIGS. 13*a*–13*d* are cross-sectional views through four different variations of gripping members showing alternative shelf details required to accommodate thence variations.

FIGS. 13*a*–13*d* illustrate four different methods of securing the spring loaded rods 42 to the shelf. In FIG. 13*a*, the housing element 121 is fixed in position by spot welding 123 and a compression spring 124 provides the biasing action.

Figure 13B:
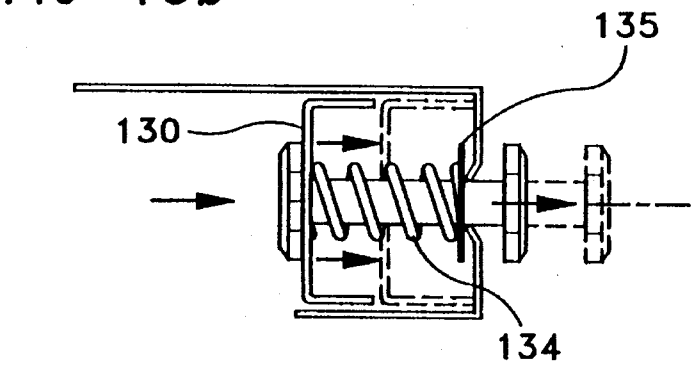

In FIG. 13*b*, the housing element 130 is movable and the spring 134 is retained by a washer 135.

Figure 13C:
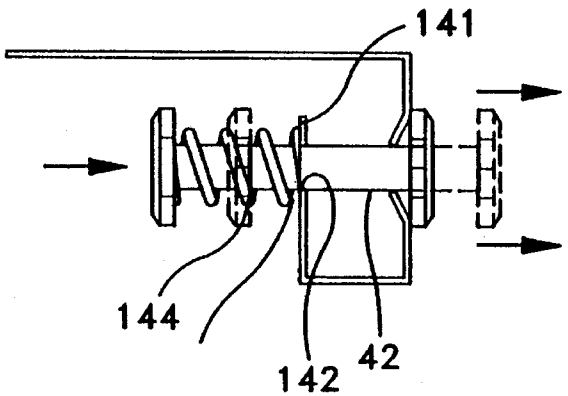

In FIG. 13*c*, the profile of the shelf is continued to provide an upstand 141 parallel to the skirt of the shelf. An orifice 142 is provided in the upstand to accommodate the shank. Spring 144 engages against the upstand 141.

Figure 13D:
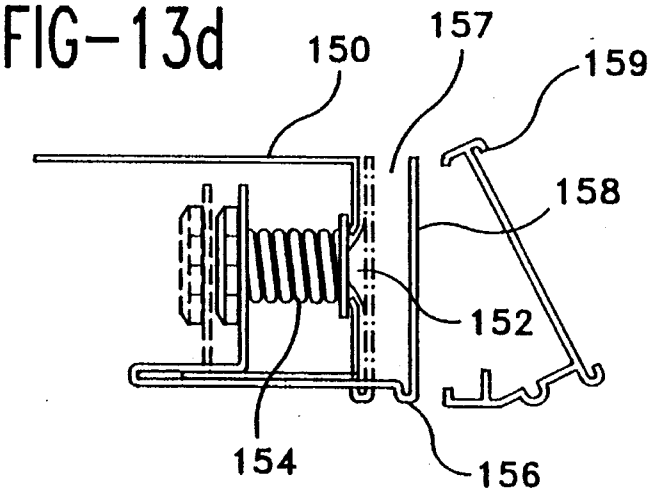

The embodiment of gripping member 150 shown in FIG. 13*d* has a fixed shank 152, a compression spring 154 and a substantially U-shaped metal pressing or extrusion 156 which is a gripping element having a channel 157 to accommodate a riser. A separate facia element 159 clips over the front wall 158 of the gripping element 156.

Figure 15:
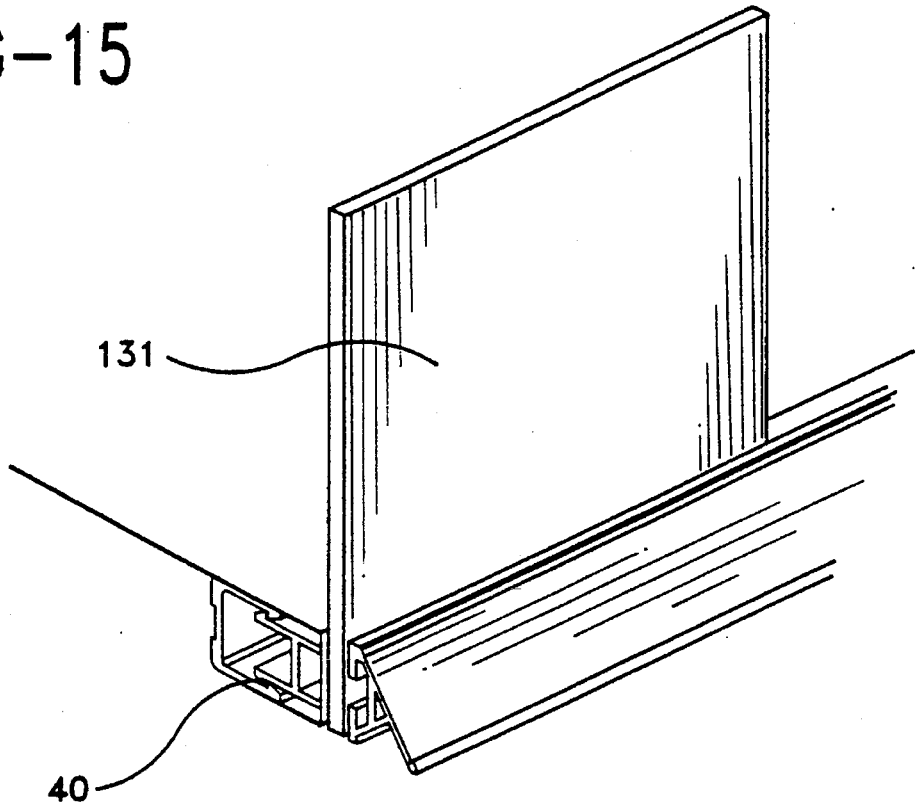
FIG. 15 is a perspective view of the shelf with the gripping member engaging a sign display element.

The gripping member 40 may be used to accommodate other items as shown in FIGS. 14–16*b* of the drawings. In FIG. 14, a shelf extension 120 is engaged with the gripping member 40 and may be used for special product displays etc. In FIG. 15, a holder 131 for a point of sale (POS) sign is engaged with the gripping member 40. This holder can be of any material or combination of materials normally used for signage.

Figure 16A:
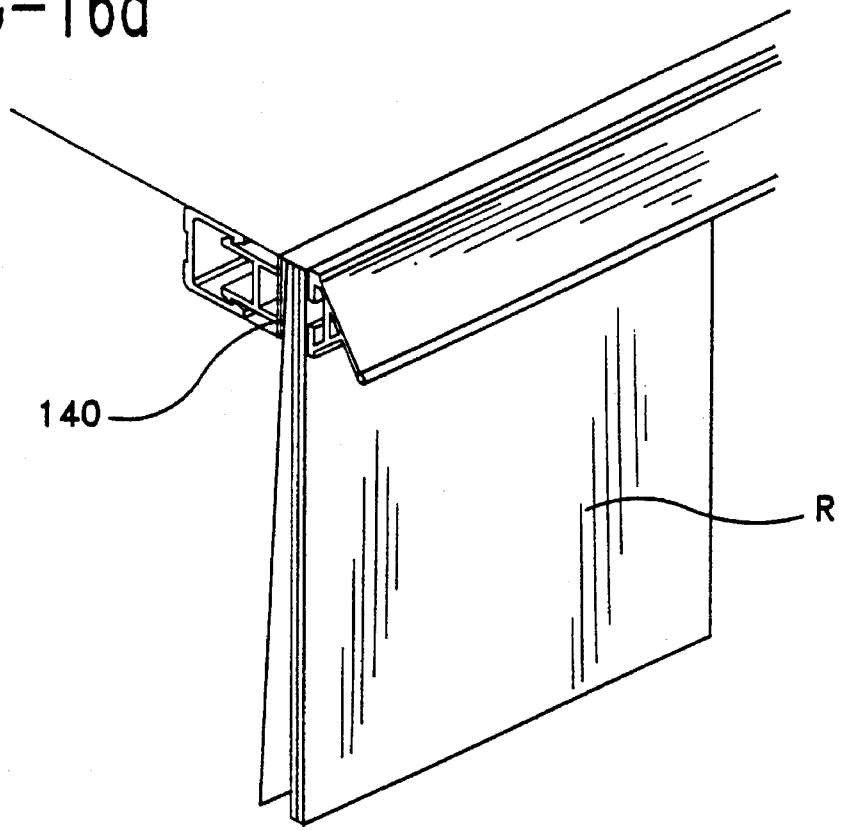
FIGS. 16*a*–16*b* are perspective views of the gripping member showing two variations of coupon carriers engaged with the member.
Figure 16B:
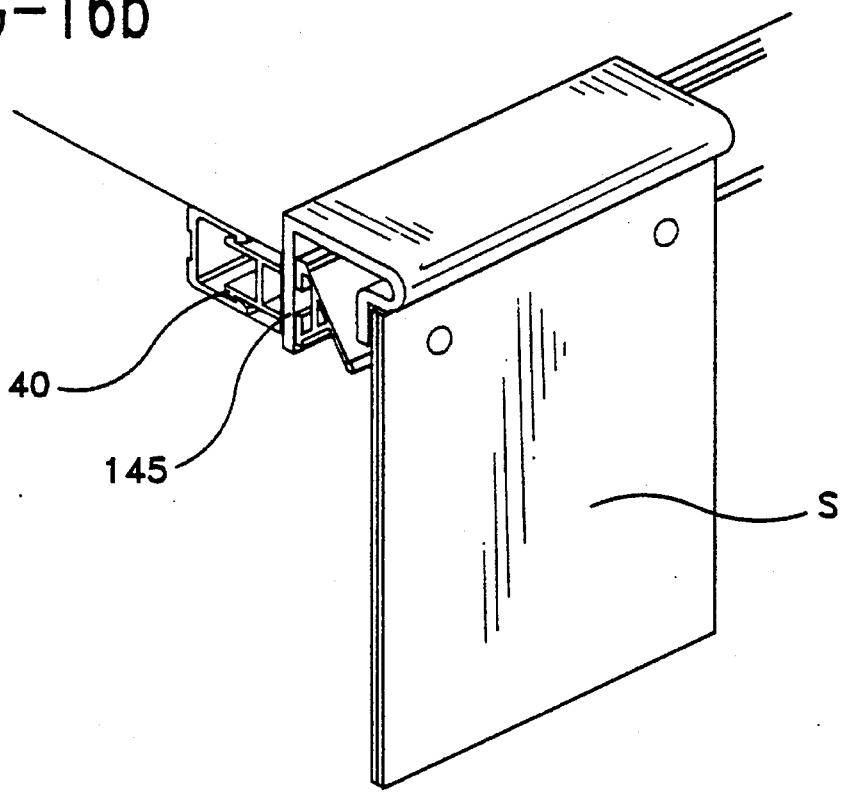

Two variations of coupon book holders 140, 145 are shown in FIGS. 16 and 16*a* and 16*b*, respectively. These are also engaged with the gripping member 40 and provide a means for supporting tear-off coupons R and S as used in special offers and the like in retail displays.

Figure 20:
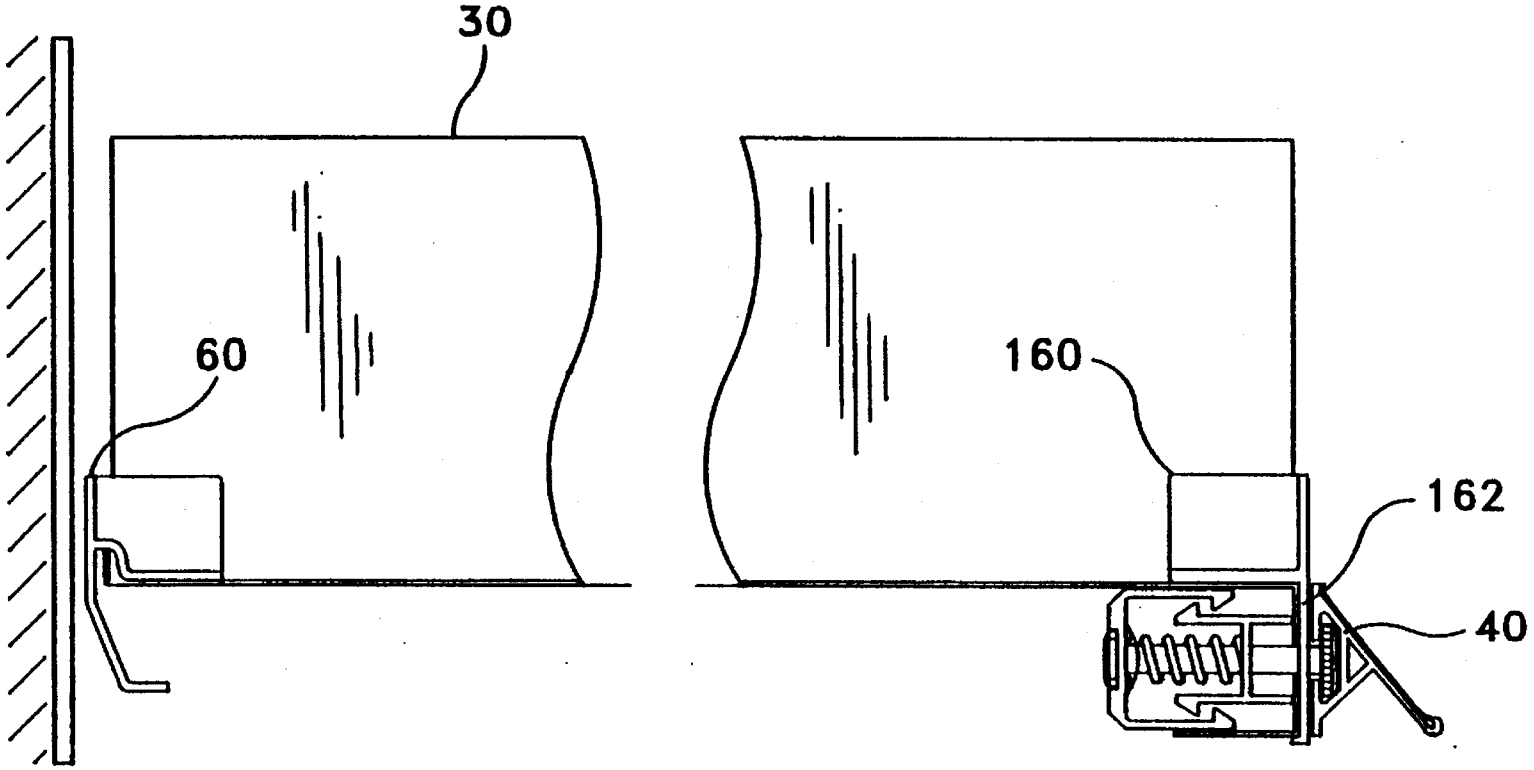
FIG. 20 is a cross-sectional view through a further embodiment of shelf assembly according to the invention.
Figure 21A:
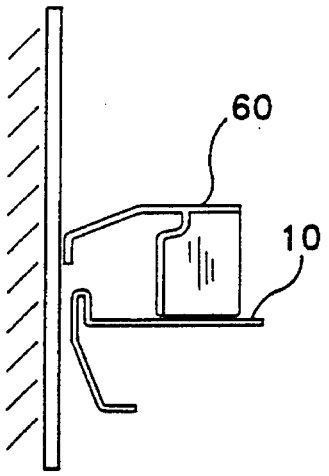
FIGS. 21*a*–21*c* are a series of three progressive views showing the assembly of components of the embodiment FIG. 20.
Figure 21B:
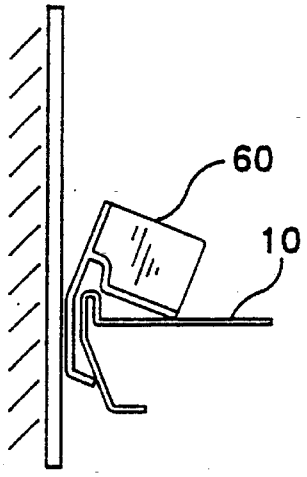
Figure 21C:
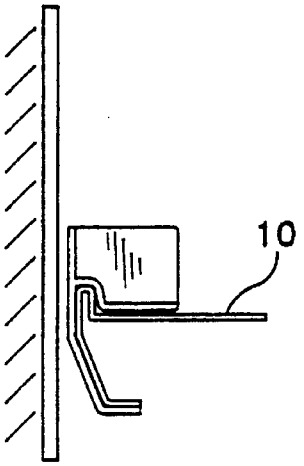
Figure 22A:
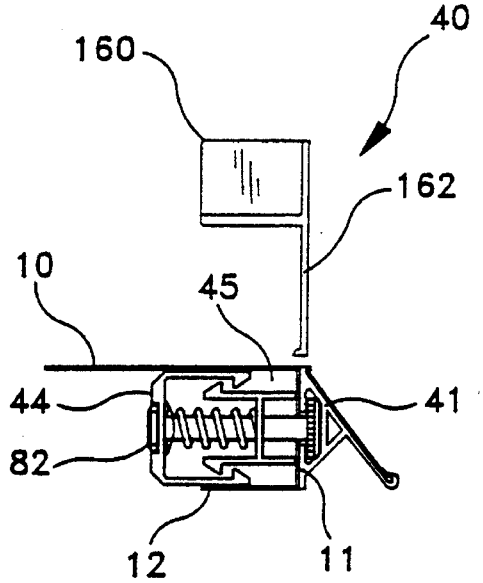
FIG. 22*a*–22*c* are a further series of three progressive views showing the assembly of components of the embodiments of FIG. 20.
Figure 22B:
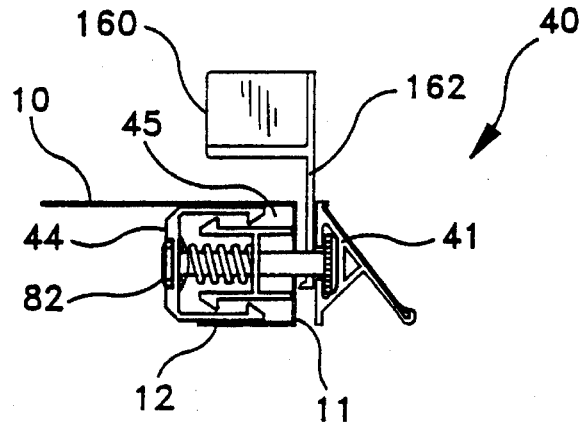
Figure 22C:
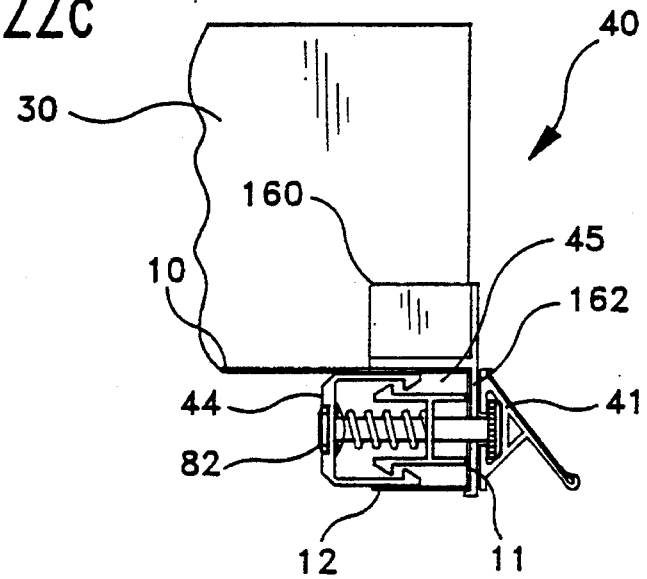

In the embodiment of shelf assembly shown in FIG. 20, a clip 60 is shown supporting the rear corner of divider. 30. A separate connector clip 160 is provided at the front of the shelf held is position by the gripping member 40. The clip 160 is similar to the clip 60, except that it has a straight leg 162 and grips the front comer of the divider 30. In this embodiment, no riser is provided on the shelf and this can be used in situations where there is no necessity for a riser.

Figure 17:
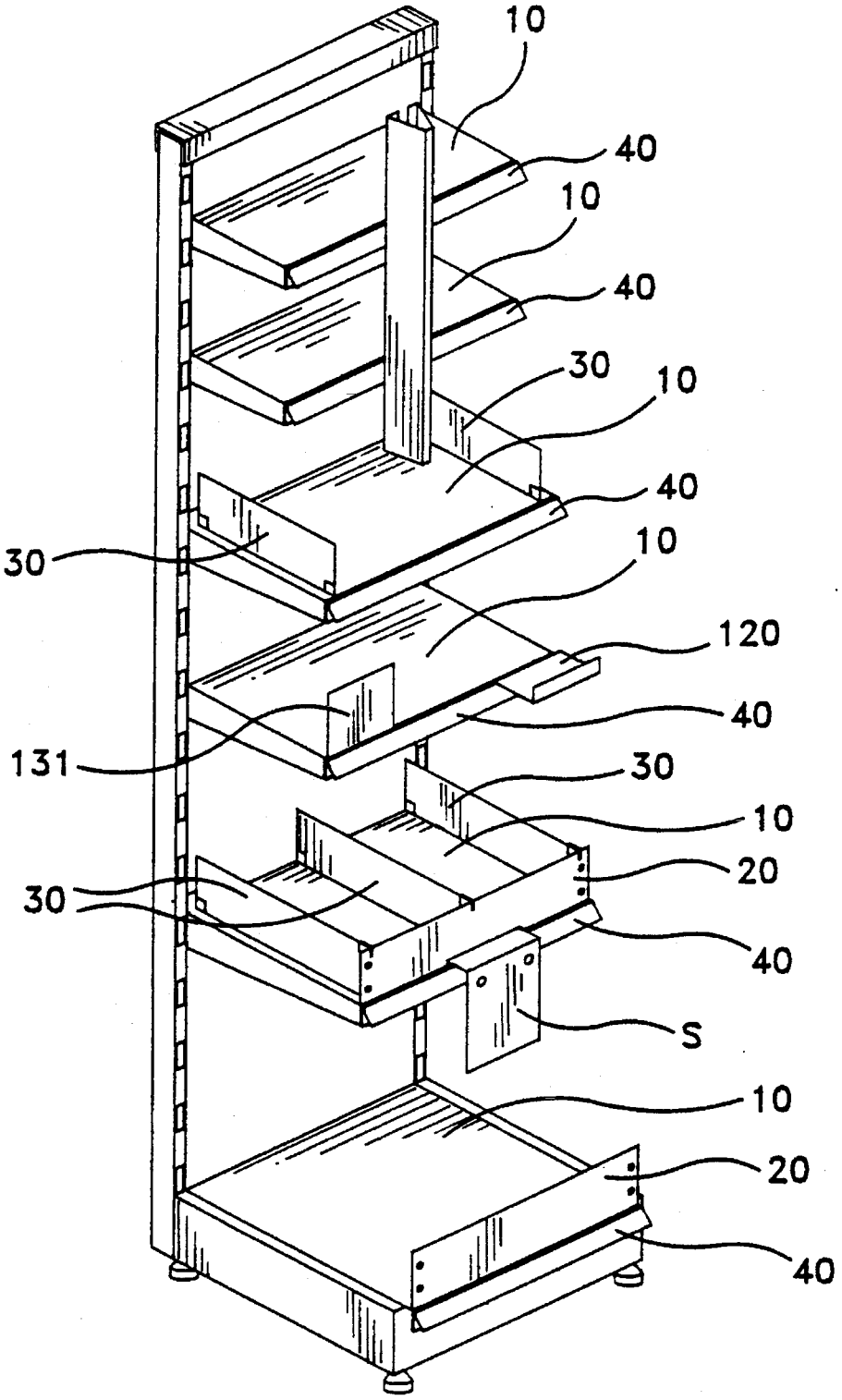
FIG. 17 is a perspective view of a plurality of shelves according to the invention mounted on a support system and showing various applications of the invention.
Figure 18:
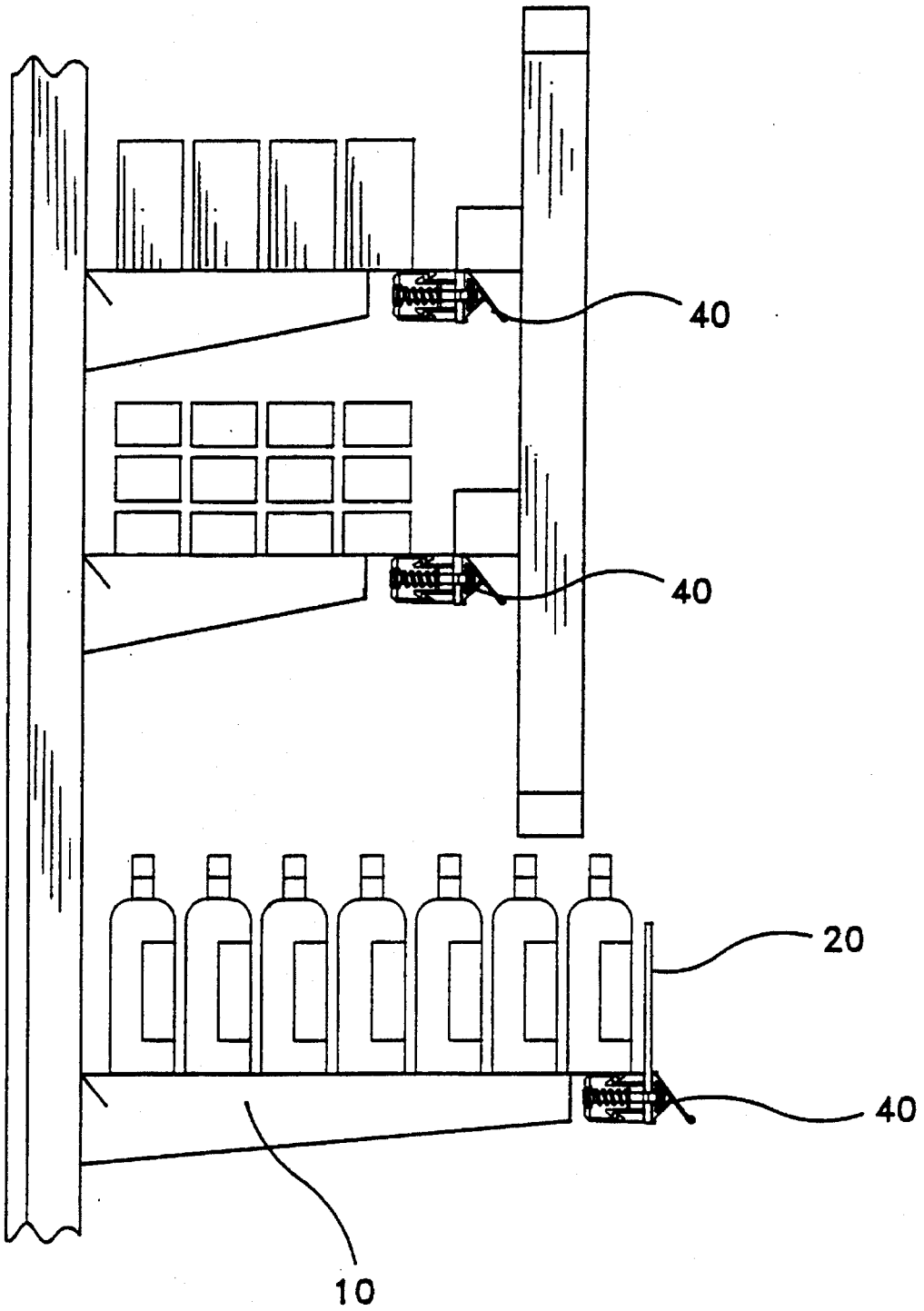
FIG. 18 is a side view of typical point of sale items applied to embodiments of shelves according to the invention.
Figure 19:
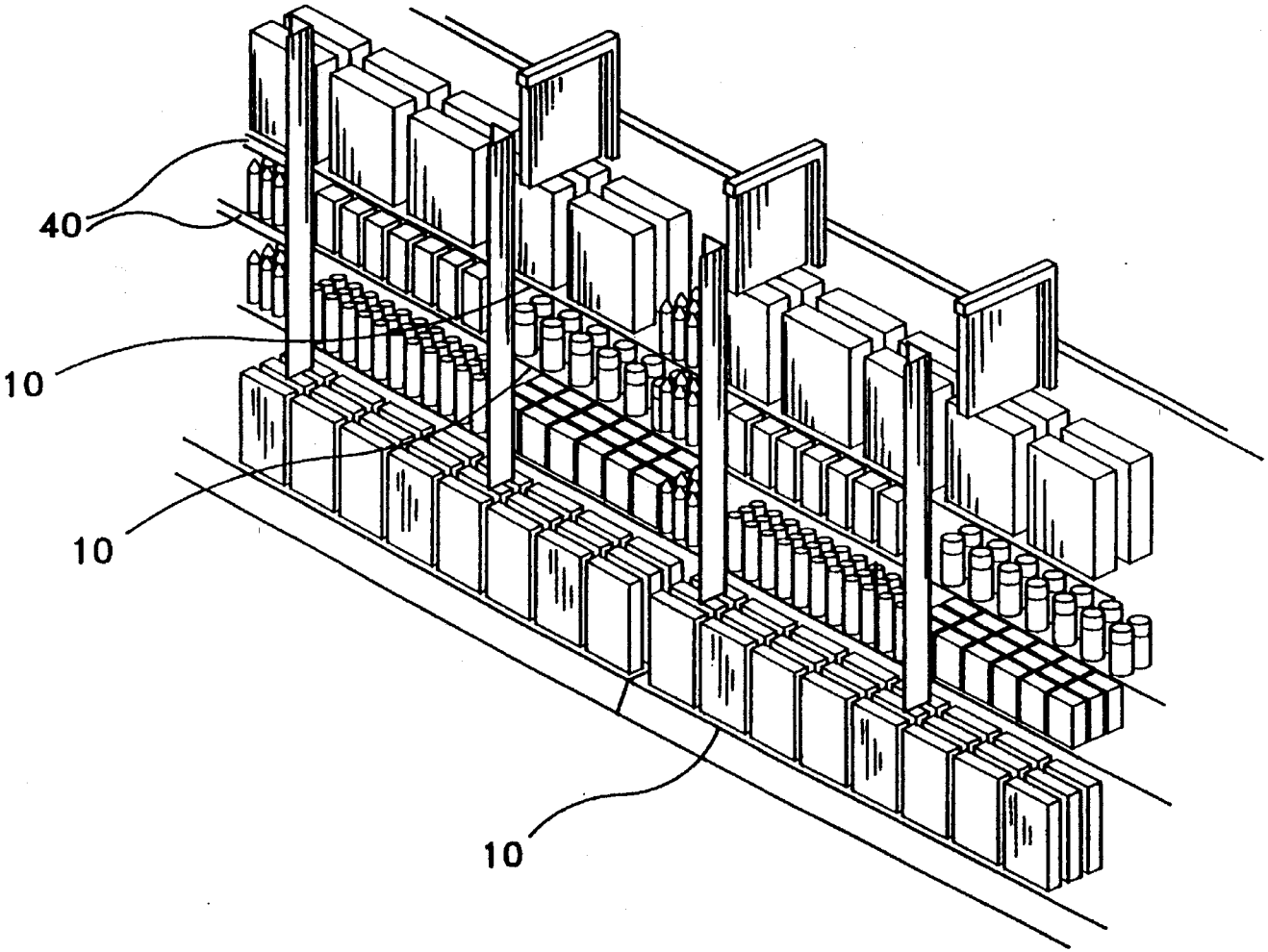
FIG. 19 is a perspective view of typical point of sale items applied to embodiments of shelves according to the invention.

As may be appreciated from FIGS. 17, 18 and 19 the shelf of the invention has universal application in the retail industry. The simple shelf profile of the invention provides significant cost saving for the shelving manufacturer in set up and production costs over prior art designs involving complicated channel edge details or multiple edge perforations merely and solely to accommodate specific riser/divider elements. The independent spring loaded shelf edge assembly of the invention provides the means to retain riser/divider elements of any material or thickness while also providing the means to support an infinite variety of ticket strips, POS displays, extension shelves, coupon dispensers, etc. The entire assembly or parts thereof can be sourced independent of the shelf manufacturer, if required, and fitting can be easily affected on site by shopfitter or retailer. This aspect affords the shelf manufacturer with economy of scale in mass producing simple standard shelf units which offer an infinite variety of options to the end user without edge detail and assembly complications in production. Numerous variations of material can be used in the manufacture of the spring loaded assembly 40 for example, plastics, aluminium, metal and/or combinations of same.

Electronic shelf edge labelling for prices and other information can also be incorporated into the facia element of the gripping member of the shelving system of the invention. It can also act as a conduit for any cabling, if required, to provide a power supply to these displays. Light or radio activated or similar power sources can also be accommodated.

To accommodate the customer who does not require the spring loaded assembly, the shelf manufacturer can fit fixed rods or pins onto the skirt of the metal shelf, with the heads of the rods being at, e.g. 6 mm or whatever desired distance from the skirt so that the slots of the riser can engage about the rods. A fixed facia element can be fitted over the heads of the pins to finish off the shelf. When the riser is removed, a slight gap remains between the facia and edge of the metal shelf. Such shelves can be used in non-critical applications.

It is to be understood that the invention is not limited to the specific details described herein, given by way of example only and that various modifications or alterations are possible without departing from the scope of the invention as defined in the appended claims.

What is claimed:

1. An elongate gripping member for fastening a shelf system component to a shelf having a planar surface and an edge, said elongate gripping member comprising:

an elongate grip element;

a mounting device having a first portion secured to said elongate grip element and a second portion secured against said edge of said shelf, said mounting device being configured and dimensioned to permit cooperative relative movement between said first portion secured to said elongate grip element and said second portion secured against said edge of said shelf to define a shelf system component receiving gap between said edge and said elongate grip element; and a biasing member for biasing said elongate grip element against said edge of said shelf with sufficient force to securely fasten said shelf system component in said shelf system component receiving gap.

2. The elongate gripping member of claim 1, further comprising:

a housing substantially enclosing said biasing member;

a plurality of rods having first and second ends, said first ends of said rods being fixed to said first portion of said mounting device and said second ends of said rods being removably engaged with said elongate grip element, whereby said first portion of said mounting device is secured to said elongate grip element; and first and second travel stops disposed on at least one of said elongate gripping member and said shelf for limiting said cooperative relative movement.

3. The elongate gripping member of claim 2, wherein:

said housing is formed by said first and second portions of said mounting device; and said first and second travel stops comprise complementary engagable formations formed respectively on said first and second portions of said mounting device which permit assembly of said first and second portions but prevent separation of said first and second portions under action of said biasing member.

4. A shelving system for receiving a shelf system component, said shelving system comprising:

a shelf having a planar surface and an edge; and an elongate gripping member including:

an elongate grip element;

a mounting device having a first portion secured to said elongate grip element and a second portion secured against said edge of said shelf, said mounting device being configured and dimensioned to permit cooperative relative movement between said first portion secured to said elongate grip element and said second portion secured against said edge of said shelf to define a shelf system component receiving gap between said edge and said elongate grip element; and a biasing member for biasing said elongate grip element against said edge of said shelf with sufficient force to securely fasten said shelf system component in said shelf system component receiving gap.

5. The shelving system of claim 4, wherein said edge is a front edge and said gripping member is provided along said front edge, further comprising:

a rear edge of said shelf; and an upstand provided at said rear edge of said shelf so as to form a low rear wall.

6. The shelving system of claim 4, further comprising:

at least a second edge; and a resilient connector clip configured for securing a divider element positioned on said surface of said shelf, said resilient connector clip being removably mounted along one of said edges of said shelf.

7. The shelving system of claim 4, further comprising an outer facia element removably attached to said elongate grip element.

8. The shelving system of claim 7, further comprising a retainer for merchandising matter, said retainer being secured to said outer facia element.

9. The shelving system of claim 4, wherein:

said edge of said shelf is formed with a depending skirt having a plurality of orifices therethrough; and said biasing member is located beneath said planar surface and adjacent said skirt; further comprising:

a plurality of rods extending through said orifices, said rods having first and second ends, said first ends of said rods being fixed to said first portion of said mounting device and said second ends of said rods being removably engaged with said elongate grip element, whereby said first portion of said mounting device is secured to said elongate grip element; and first and second travel stops disposed on at least one of said elongate grip element and said mounting device for limiting said cooperative relative movement.

10. The shelving system of claim 9, wherein said travel stops are disposed about said rods.

11. The shelving system of claim 9, wherein:

said depending skirt of said edge of said shelf is formed with a return tab to make a substantially U-shaped region at said edge of said shelf; and said first and second portions of said mounting device form a housing, said housing being located in said U-shaped region, said housing having at least one of said travel stops.

12. The shelving system of claim 11, wherein said first and second travel stops comprise complementary engagable formations formed respectively on said first and second portions of said mounting device which permit assembly of said first and second portions but prevent separation of said first and second portions under action of said biasing member.

13. The shelving system of claim 9, wherein said elongate grip element is provided with a channel, and further comprising heads formed on said second ends of said rods, said heads being configured and dimensioned for engagement with said channel, whereby said rods are removably engaged with said elongate grip element.

* * * * *